United States Patent [19]

Vigouroux

[11] Patent Number: 4,978,109

[45] Date of Patent: Dec. 18, 1990

[54] UNITARY CONSTRUCTION MULTIDECK TRAY DEVICE FOR HEAT TREATMENT OF SHAFTS OR LIKE MEMBERS

[75] Inventor: Emile Vigouroux, Arnage, France

[73] Assignee: Societe Mancelle de Fonderie, Arnage, France

[21] Appl. No.: 284,549

[22] Filed: Dec. 15, 1988

[30] Foreign Application Priority Data

Jan. 15, 1988 [FR] France ..... 88 00451

[51] Int. Cl.[5] ..... C21D 9/00

[52] U.S. Cl. ..... 266/274; 266/258; 432/261

[58] Field of Search ..... 266/249, 274, 258; 432/261

[56] References Cited

U.S. PATENT DOCUMENTS

| | | | |
|---|---|---|---|
| 2,137,737 | 11/1938 | Wenzel | 266/274 |
| 2,179,073 | 11/1939 | Dames | 266/249 |
| 2,300,783 | 11/1942 | Grubel et al. | 432/261 |
| 2,369,756 | 2/1945 | Sackerson | 432/261 |
| 4,212,690 | 7/1980 | Beuyakian et al. | 266/249 |
| 4,815,971 | 3/1989 | Bucher | 432/261 |

FOREIGN PATENT DOCUMENTS

| | | | |
|---|---|---|---|
| 0389154 | 11/1973 | U.S.S.R. | 432/261 |

*Primary Examiner*—S. Kastler

*Attorney, Agent, or Firm*—Beveridge, DeGrandi & Weilacher

[57] ABSTRACT

A device for heat treatment of shafts or like members in a vertical position comprises a unitary construction tray. This includes an upper deck formed with support holes, optionally on a plurality of alternate levels. These holes support and center a lower end of the shafts or like members. Horizontal ribs join the holes. A lower deck of the tray also comprises holes and ribs, and pillars join the ribs of the upper and lower decks in such a way as to leave large gaps for fluid to circulate through.

6 Claims, 3 Drawing Sheets

3
1
2
3
3
10
19
4
20
21
16
3
8b
8a
18
4
17
21

UNITARY CONSTRUCTION MULTIDECK TRAY DEVICE FOR HEAT TREATMENT OF SHAFTS OR LIKE MEMBERS

BACKGROUND OF THE INVENTION

1. Field of the invention

The invention concerns support and handling devices for batch heat treatment of mechanical parts such as shafts or like members.

2. Description of the prior art

The most commonly used heat treatment devices are of two types: a first type on which the parts are placed and guided and a second type on which the parts are suspended.

Devices of the first type comprise a basic handling tray including columns on which are mounted a lower grid and an upper grid separated by tubular spacers surrounding the columns, each part being supported by an intermediary support member mounted in one of the housings of the lower grid and guided in its upper part by an intermediary guide member mounted in a similar opening in the upper grid.

Devices of the second type include the same component parts as those of the first type except the lower grid and the intermediary guide members, the intermediary support members being of a special type and mounted in the upper grid.

The major disadvantages of both these types of device are the multiplicity of component parts, the high weight of the device as compared with the weight of the parts treated and its commensurate thermal inertia, the complexity of the handling operations for loading the parts which in practise rules out automatic loading and unloading, and finally the imperfect holding of the parts leading to impacts between parts compromising their quality.

An object of the invention is to eliminate the aforementioned disadvantages, in other words to provide a device which, like the previous devices, secures vertical positioning of the parts to avoid deformation during treatment but which is as light as possible whilst grouping the maximum number of parts to maximize the usable load and the number of parts treated per batch, which favors cooling conditions during quenching through good fluid flow, which is highly resistant to thermal shock and to thrust forces in a pusher type furnace and which, finally, enables parts to be loaded in a way that is easily automated.

SUMMARY OF THE INVENTION

The present invention consists in a device for heat treatment of shafts or like members in a vertical position comprising a unitary construction tray including an upper deck formed with support holes, optionally on a plurality of alternate levels, adapted to support and center a lower end of said shafts or like members and horizontal ribs joining said holes, a lower deck also comprising holes and ribs and pillars joining said ribs of said upper and lower decks in such a way as to leave large gaps for fluid to circulate through.

Optionally a plurality of such trays loaded with parts can be superposed by means of stepped columns.

Other features of the invention will emerge from the following description of two embodiments given by way of example with reference to the appended drawings.

DESCRIPTION OF THE PREFERRED EMBODIMENTS

In the chosen embodiments the parts 1 to be treated are gearbox shafts 2 comprising a plurality of gears 3 in one piece with the shaft 2, this type of part being particularly difficult to treat. Of course, the invention is equally applicable to elongate parts of simpler and less bulky shape.

Figure 1:
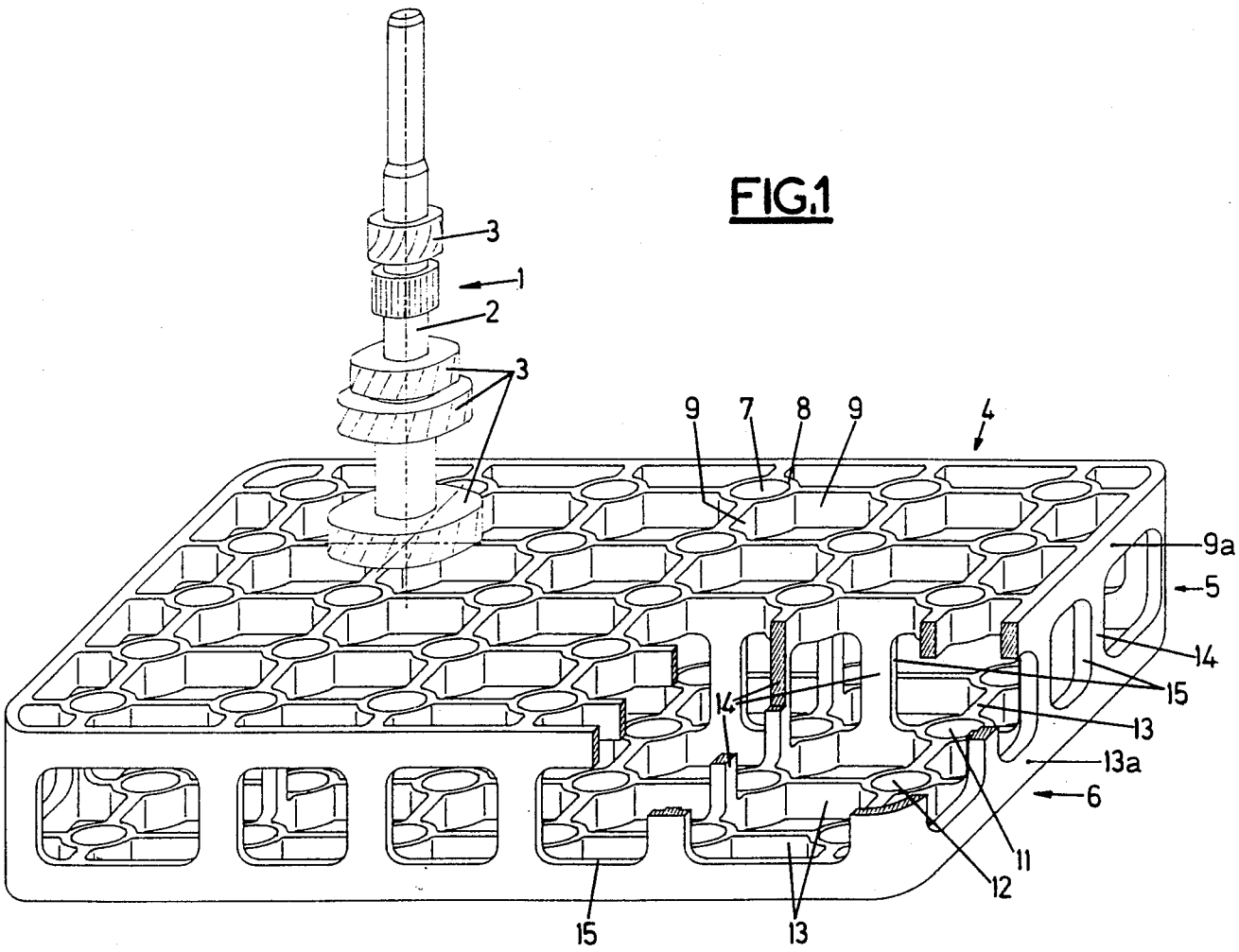
FIG. 1 is a partially cutaway perspective view of a first embodiment with a single part to be treated in place.

There is seen in FIG. 1 the one-piece assembly 4 forming a tray with two decks 5 and 6. The upper deck 5 includes a number of holes 7 each surrounded by a tubular sleeve 8, the various holes 7 and sleeves 8 being arranged in a two-dimensional array and joined to each other by ribs 9 in at least two directions. Each hole 7 is adapted to receive a cylindrical lower portion 10 of one of the parts 1 which rests through a conical or plane portion on the upper edge of the corresponding sleeve 8.

Figure 2:
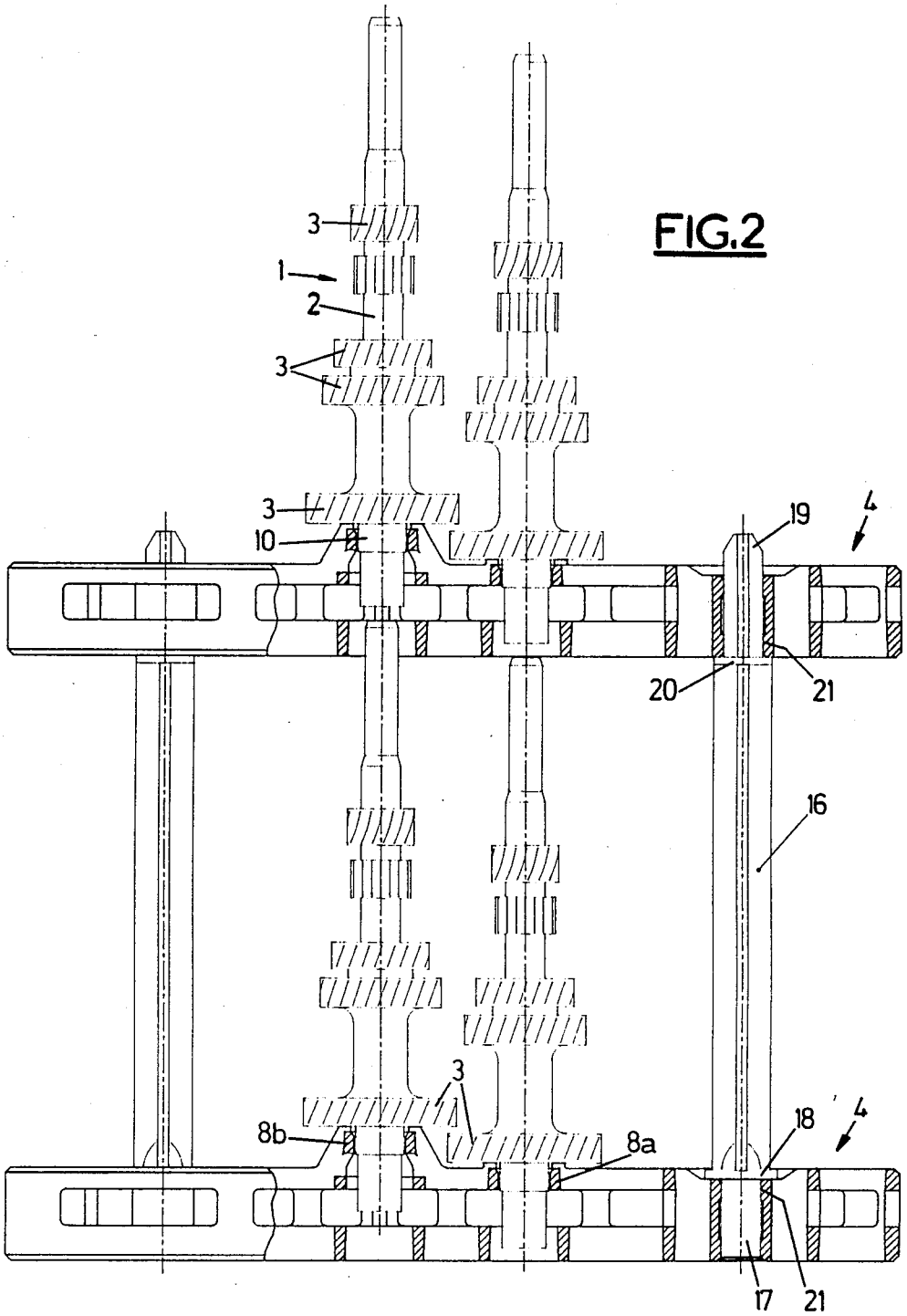
FIG. 2 is an elevation view of the second embodiment in partial cross-section.
Figure 3:
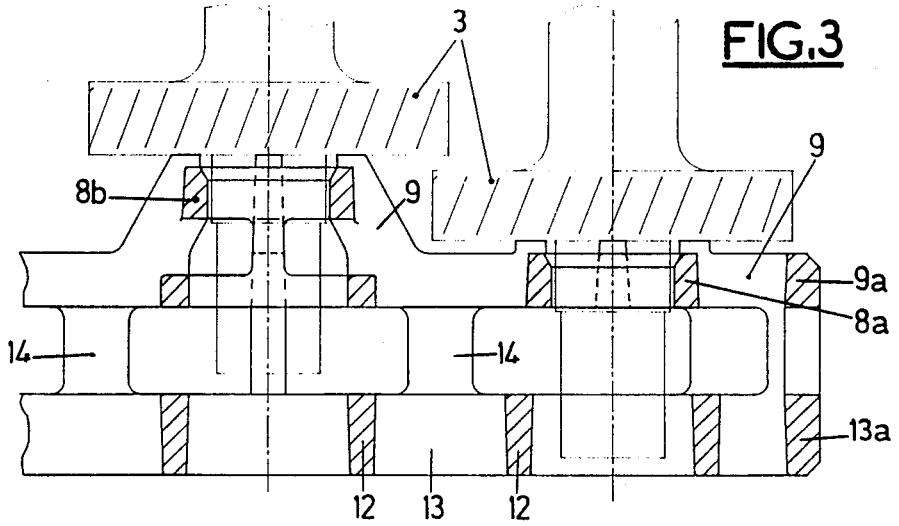
FIG. 3 shows a detail of the second embodiment in cross-section and to a larger scale.

The lower deck 6 is also made up of holes 11 surrounded by cylindrical sleeves 12 in turn joined by ribs 13, preferably also in two directions. Special surrounding ribs **9*a* surround all of the upper deck 5 and likewise special ribs 13*a* surround all of the lower deck 6. FIGS. 2 and 3** show that the through holes in the lower deck have a larger diameter than the corresponding axially aligned through holes in the upper deck.

Also, a series of vertical pillars 14 join the ribs such as 9 or **9*a* of the upper deck and the ribs such as 13 or 13*a* of the lower deck in pairs. Finally, as seen clearly in FIG. 1, all the ribs and the pillars leave between them large gaps 15** for free circulation of the heating fluid (and subsequently cooling fluid) which also reduce the weight of the device while retaining its high strength.

In accordance with the invention all of the tray 4 is made in one piece, which can easily be done by casting, for example, in an alloy with high resistance to thermal shock.

Figure 4:
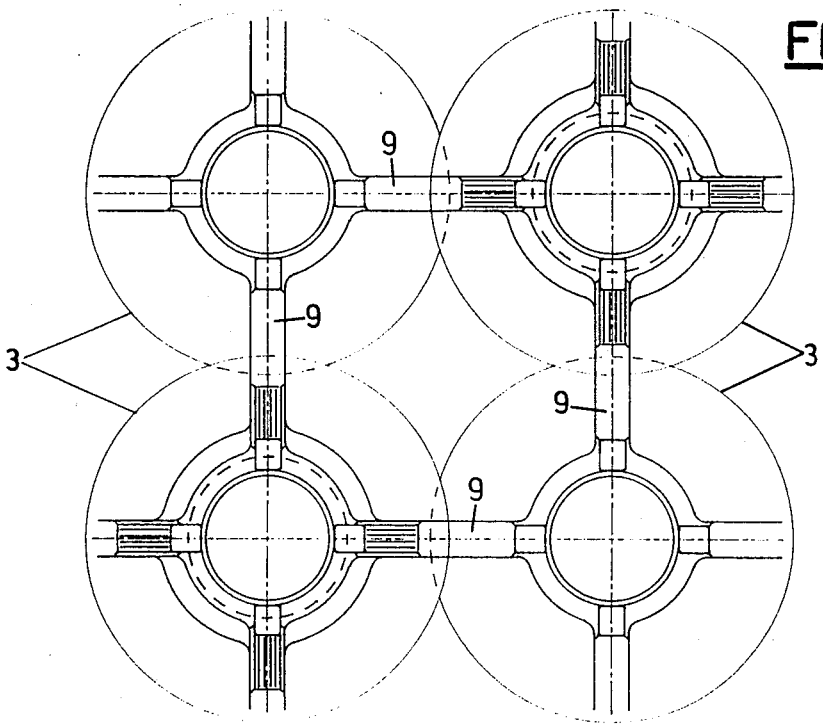
FIG. 4 is a plan view of FIG. 3.

In the second embodiment of FIGS. 2 through 4 the holes 7 and the sleeves 8 of the upper deck are disposed on two alternate levels, as at **8*a* and 8*b*, in order to avoid (as seen in FIG. 2 and 3) interference between the gears 3 of largest diameter so that the distance between the holes 7** can be reduced and the load per tray thereby increased.

In both cases there is therefore provided a unitary construction tray with two decks which is very rigid and which deforms in a uniform way during heat treatment. Furthermore, the assembly is relatively simple and light in weight, especially in relation to the weight of the parts supported, while it improves the quality of the parts by securing excellent retention to prevent impacts between the parts during treatment and during loading.

What is more, the parts are loaded in an extremely simple way since it suffices to offer up each part opposite the corresponding hole 7 and to insert it therein by a simple vertical axial translation movement, which can easily be done by a manipulator arm. Finally, in addition to the low cost, high strength and low weight of the tray in accordance with the invention the weight of the parts supported may be relatively high, especially with the second embodiment.

Furthermore, the invention makes it possible, if required, to superpose two or more similar trays for simultaneous heat treatment by stacking the trays, once loaded with their parts, one on another by means of stepped columns such as that shown at 16 in FIG. 2, each of these columns having, for example, an X-shaped cross-section with a cylindrical lower termination 17 with flange 18 and an upper termination 19 which may also be X-shaped in cross-section and incorporate an abutment flange 20. The terminations 17 and 18 may be fitted into additional holes provided for this purpose, in the corners of each tray 4, for example. This latter arrangement further increases the loading density and therefore the productivity of the heat treatment process.

I claim:

1. A heat treating assembly comprising a one piece tray for supporting the lower ends of one set of vertically positioned shaft or elongated members, said tray having only two decks;

an upper said deck provided with a plurality of vertical through holes for supporting and centering lower end portions of all members in said set of vertically positioned shafts or elongated members to be thermally treated in a furnace, said through holes being surrounded by sleeves joined to each other by horizontal ribs in at least two directions;

a lower said deck spaced below the upper deck a distance such that it receives the lower end portions of said members supported and centered on the upper deck, said lower deck being provided with through holes vertically aligned with the through holes in the upper deck; horizontal ribs extending between the holes in the lower deck in at least two directions;

pillars joining said horizontal ribs of the upper and lower decks in such a way as to leave large gaps between said decks for weight reduction and for free circulation of a heating fluid or a cooling fluid therethrough.

2. An assembly as claimed in claim 1, wherein said tray is a unitary casting.

3. An assembly as claimed in claim 1, further including holes for receiving stepped columns to permit the stacking of a plurality of trays each of which is loaded with shafts or elongated members.

4. An assembly as claimed in claim 1, wherein said sleeves surrounded said vertical through holes in said upper deck are at different elevations.

5. An assembly as claimed in claim 1, wherein said through holes of the lower deck have a larger diameter than said through holes of the upper deck.

6. A heat treating assembly comprising a one piece tray including:

an upper deck provided with a plurality of vertical through holes for supporting and centering lower end portions of a set of vertically positioned shafts or elongated workpiece members to be thermally treated in a furnace, said through holes being surrounded by sleeves joined to each other by horizontal ribs in at least two directions;

a lower deck spaced below the upper deck a distance such that it receives the lower end portions of said members supported and centered on the upper deck, said lower deck being provided with through holes vertically aligned with the through holes in the upper deck; horizontal ribs extending between the holes in the lower deck in at least two directions;

pillars joining said horizontal ribs of the upper and lower decks in such a way as to leave large gaps between said decks for weight reduction and for free circulation of a heating fluid or a cooling fluid therethrough;

said heat treating assembly further including a plurality of vertically positioned elongated workpiece members supported therein, at least one of said members extending into the through holes of said upper deck and said lower deck.

* * * * *